US010021768B2

(12) United States Patent
Arai

(10) Patent No.: US 10,021,768 B2
(45) Date of Patent: Jul. 10, 2018

(54) LIGHTING APPARATUS

(71) Applicant: PANASONIC INTELLECTUAL PROPERTY MANAGEMENT CO., LTD., Osaka (JP)

(72) Inventor: Takafumi Arai, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/491,242

(22) Filed: Apr. 19, 2017

(65) Prior Publication Data

US 2017/0311422 A1 Oct. 26, 2017

(30) Foreign Application Priority Data

Apr. 22, 2016 (JP) ..... 2016-086505

(51) Int. Cl.

| | |
|---|---|
| ***H05B 37/02*** | (2006.01) |
| ***F21V 29/89*** | (2015.01) |
| ***F21S 9/02*** | (2006.01) |
| ***F21V 3/02*** | (2006.01) |
| ***F21V 23/00*** | (2015.01) |
| ***F21V 23/02*** | (2006.01) |
| ***F21V 23/06*** | (2006.01) |
| ***H04R 1/02*** | (2006.01) |
| ***H05B 33/08*** | (2006.01) |
| *F21Y 115/10* | (2016.01) |

(52) U.S. Cl.

CPC ..... *H05B 37/0272* (2013.01); *F21S 9/02* (2013.01); *F21V 3/02* (2013.01); *F21V 23/001* (2013.01); *F21V 23/023* (2013.01); *F21V 23/06* (2013.01); *F21V 29/89* (2015.01); *H04R 1/028* (2013.01); *H05B 33/0845* (2013.01); *F21Y 2115/10* (2016.08)

(58) Field of Classification Search

CPC . H05B 37/0272; H05B 33/0845; F21V 29/89; F21V 3/02; F21V 23/001; F21V 23/023; F21V 23/06; F21S 9/02; H04R 1/028; F21Y 2115/10

USPC ..... 362/234

See application file for complete search history.

(56) References Cited

U.S. PATENT DOCUMENTS

2012/0236558 A1* 9/2012 Roudeski ..... B64F 1/20 362/235
2014/0268697 A1* 9/2014 Smith ..... F21S 9/022 362/183

(Continued)

FOREIGN PATENT DOCUMENTS

| | | |
|---|---|---|
| JP | 2015-156292 | 8/2015 |
| JP | 2016-081569 | 5/2016 |

*Primary Examiner* — Laura Tso

(74) *Attorney, Agent, or Firm* — Greenblum & Bernstein, P.L.C.

(57) ABSTRACT

A lighting apparatus includes: a light source unit including a light emitter and a first casing in which the light emitter is housed; a communication unit including a radio receiver which receives a wireless signal for controlling a light emitting state of the light emitter and second casing in which the radio receiver is housed; a first power line including a plug and connected to the communication unit; and a power source which generates power for causing the light emitter to emit light, using power received by the plug.

11 Claims, 6 Drawing Sheets

(56) References Cited

U.S. PATENT DOCUMENTS

| | | | | |
|---|---|---|---|---|
| 2014/0268733 | A1* | 9/2014 | Holland | F21V 21/096 362/231 |
| 2014/0293592 | A1* | 10/2014 | Hopper | H05B 33/0803 362/183 |
| 2015/0276203 | A1* | 10/2015 | McBee | F21V 33/0008 362/465 |
| 2016/0047537 | A1* | 2/2016 | Stolte | F21V 23/0435 362/276 |
| 2016/0084447 | A1* | 3/2016 | Scribante | F21V 21/03 362/223 |
| 2016/0102825 | A1* | 4/2016 | Scribante | F21S 8/022 362/217.12 |

* cited by examiner

LIGHTING APPARATUS

CROSS REFERENCE TO RELATED APPLICATION

This application claims the benefit of priority of Japanese Patent Application Number 2016-086505 filed on Apr. 22, 2016, the entire content of which is hereby incorporated by reference.

BACKGROUND

1. Technical Field

The present disclosure relates to lighting apparatuses, and in particular, to a lighting apparatus including a light emitting diode (LED) as a light source.

2. Description of the Related Art

Conventionally known lighting apparatuses include downlights which are recessed-type ceiling lights, direct-mounted ceiling lights, spotlights, etc.

Such lighting apparatuses are directly attached to a construction material such as a ceiling and a wall of a building. Accordingly, there are cases where installation work which involves an electrical engineering work by a professional electrical worker is required, or a user is not allowed to freely change the installation locations once the lighting apparatuses are installed.

In view of the above, a lighting apparatus which includes a lamp body to which a code attached with a plug is connected has been proposed (see, for example, Japanese Unexamined Patent Application Publication No. 2015-156292). According to the lighting apparatus disclosed by Japanese Unexamined Patent Application Publication No. 2015-156292 since a user only have to insert a plug into an outlet, installation of the lighting apparatus can be easily carried out by the user. In addition, it is possible to freely change the installation location of a lighting apparatus even after the lighting apparatus is installed, as long as an outlet is available.

SUMMARY

In recent years, a lighting apparatus having a radio control function has been under consideration. The lighting apparatus having a radio control function includes, for example, a light emitter such as an LED or a fluorescent lamp, and a radio receiver which receives a wireless signal for controlling a light emitting state of the light emitter.

However, in the lighting apparatus having the radio control function, there is a restriction on a position at which the radio receiver is disposed.

The present disclosure has been conceived to solve the problem described above, and an object of the present disclosure is to provide a lighting apparatus with a high degree of freedom of the position at which the radio receiver is disposed.

In order to achieve the above-described object, a lighting apparatus according to an aspect of the present disclosure is a lighting apparatus which includes: a light source unit including emitter and a first casing in which the light emitter is housed; a communication unit including a radio receiver which receives a wireless signal for controlling a light emitting state of the light emitter, and a second casing in which the radio receiver is housed; a first power line including a plug and connected to the communication unit; and a power source which generates power for causing the light emitter to emit light, using power received by the plug.

According to present disclosure, it is possible to implement a lighting apparatus with a high degree of freedom of the position at which the radio receiver is disposed.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENT

The following describes an embodiment of the present disclosure. It should be noted that the subsequently-described embodiment shows a specific example of the present disclosure. Thus, the numerical values, shapes, materials, structural components, the disposition and connection of the structural components, and others described in the following embodiment are mere examples, and do not intend to limit the present disclosure. Furthermore, among the structural components in the following embodiment, components not recited in the independent claim which indicates the broadest concept of the present disclosure are described as arbitrary structural components.

In addition, each diagram is a schematic diagram and not necessarily strictly illustrated. Accordingly, for example, scale sizes, etc., are not necessarily exactly represented. In each of the diagrams, substantially the same structural components are assigned with the same reference signs, and redundant descriptions will be omitted or simplified.

(Embodiment)

(Lighting Apparatus)

Figure 1:
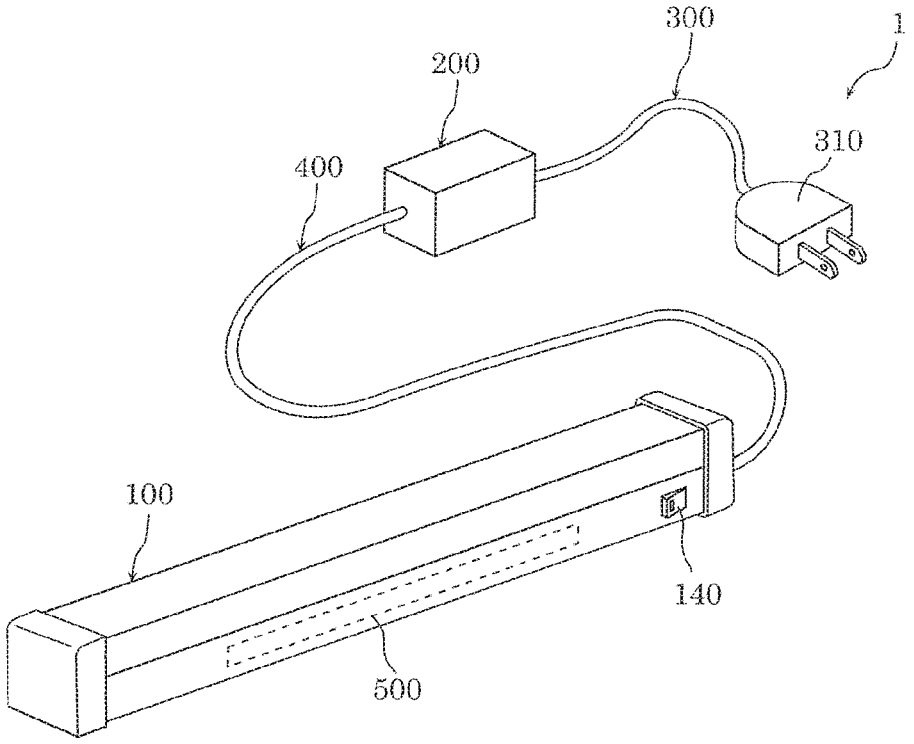
FIG. 1 is a perspective diagram which illustrates an external view of a lighting apparatus according to an embodiment.
Figure 2:
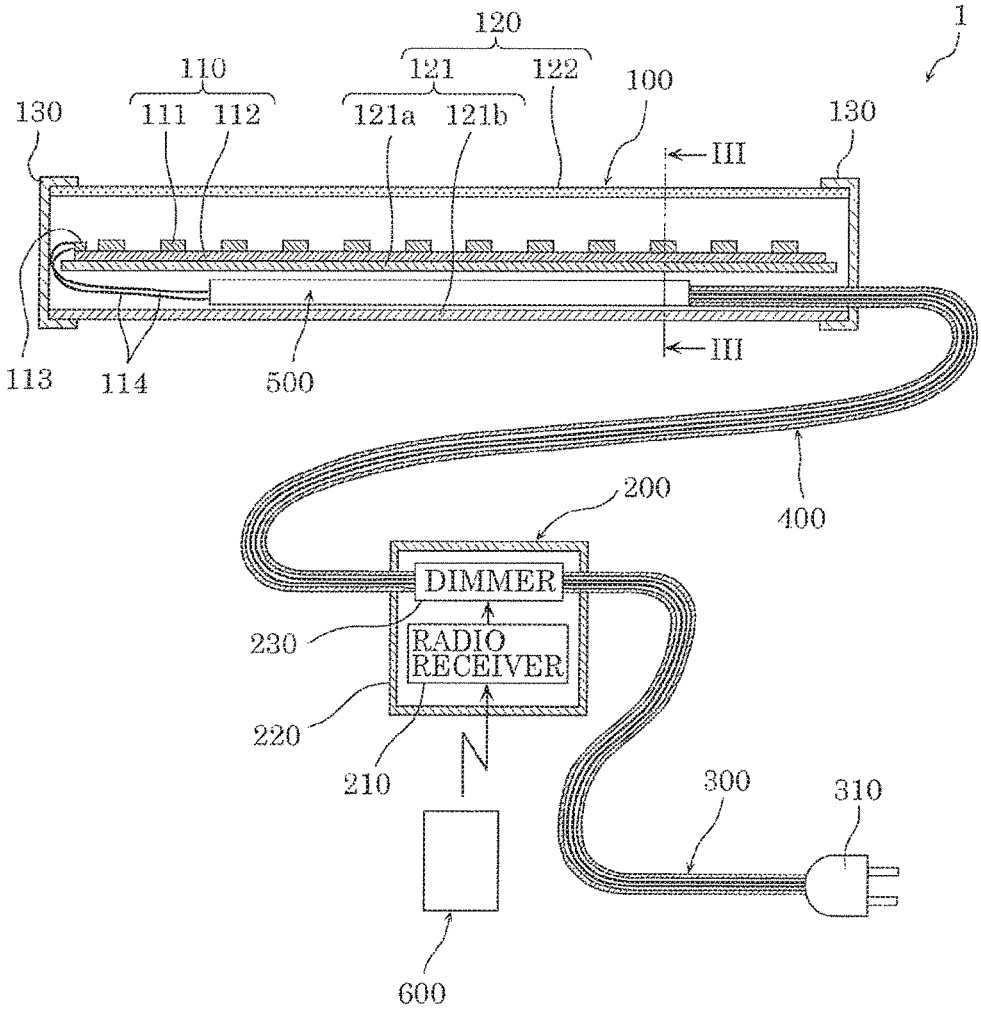
FIG. 2 is a cross-sectional diagram which schematically illustrates an internal configuration of the lighting apparatus according to the embodiment.
Figure 3:
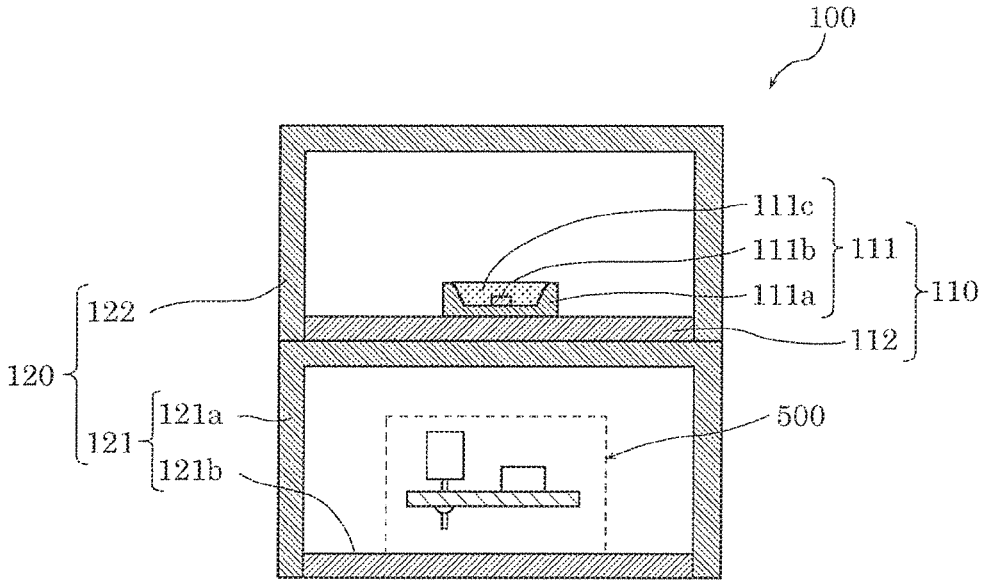
FIG. 3 is a cross-sectional diagram which illustrates a light source unit and is taken along line III-III in FIG. 2.

The following describes a configuration of lighting apparatus 1 according to an embodiment, with reference to FIG. 1 to FIG. 3. FIG. 1 is a perspective diagram which schematically illustrates an external view of lighting apparatus 1 according to the embodiment. FIG. 2 is a cross-sectional diagram which schematically illustrates an internal configuration of lighting apparatus 1. FIG. 3 is a cross-sectional diagram which illustrates an internal configuration of light source unit 100 in lighting apparatus 1. FIG. 3 illustrates a cross-section surface of light source unit 100, which is taken along line III-III in FIG. 2.

As illustrated in FIG. 1, lighting apparatus 1 includes light source unit 100, communication unit 200, first power line 300, second power line 400, and power source 500.

The light emitting state of light source unit 100 is controlled by a light control signal received by communication unit 200. As illustrated in FIG. 2, communication unit 200 receives a light control signal transmitted by terminal device 600.

According to the present embodiment, the light control signal transmitted by terminal device 600 is a wireless signal. Accordingly, a signal is transmitted and received via radio communication between communication unit 200 and terminal device 600.

The light control signal is a wireless signal for controlling the light emitting state of light source unit 100 (light emitter 110). Examples of the light control signal include, for example, an on-off signal for turning on or off light source unit 100, a dimming signal for dimming light source unit 100, etc.

In addition, terminal device 600 is a control terminal (operation terminal) which a user operates for controlling the light emitting state of light source unit 100. An example of terminal device 600 includes a mobile terminal such as a smartphone and a remote controller attached to lighting apparatus 1 for operating lighting apparatus 1.

Lighting apparatus 1 configured in this manner is installed, for example, in a living room of a house (for example, at the periphery of a sofa or a television set), a bedroom (for example, at the periphery of a bed or a shelf), a kitchen, etc., and used for indirect lighting. It should be noted that lighting apparatus 1 may be used as main illumination.

The following describes in detail, with reference to FIG. 1 to FIG. 3, each structural component included in lighting apparatus 1 according to the embodiment.

(Light Source Unit)

As illustrated in FIG. 2 and FIG. 3, light source unit 100 includes light emitter 110 and first casing 120 in which light emitter 110 is housed. Light source unit 100 further includes end cover 130. According to the embodiment, llight source unit 100 has an elongate shape, and has a length, for example, equivalent to a length of a linear tube fluorescent lamp or a linear tube LED lamp. However, light source unit 100 is not limited to this example.

Light emitter 110 has an elongate shape. One or more light emitters 110 are housed in first casing 120. According to the embodiment, light emitter 110 is an LED module (light-emitting module) using an LED, and includes a plurality of LED light sources 111 and board 112 which has an elongate shape and on which the plurality of LED light sources 111 are disposed.

The plurality of LED light sources 111 are, for example, arranged in a line along the longitudinal direction of board 112 on one of main surfaces of board 112. Each of the plurality of LED light sources 111 is, for example, a white LED light source which emits white light, using a blue LED chip that emits blue light and a yellow phosphor. As illustrated in FIG. 3, according to the present embodiment, the plurality of LED light sources 111 are each, for example, an individually packaged LED element of a surface mount device (SMD) type. Each of the plurality of LED light sources 111 includes: package 111*a* which is formed of a white resin and has a recess; LED chip 111*b* (bare chip) primarily mounted on a bottom surface of the recess of package 111*a*, and sealing member 111*c* sealed in the recess of package 111*a*. Sealing member 111*c* includes a light-transmissive resin material such as a silicone resin, for example. Sealing member 111*c* is a phosphor-containing resin which contains a wavelength-converter material such as a phosphor.

Board 112 is a mounting board for mounting LED light source 111. Examples of board 112 include, for example: a resin board including, as a base, a resin base material such as a glass epoxy base material; a metal base board including metal as a base and covered by a layer of insulating material; a ceramic board which is a sintered compact of a ceramic material such as aluminum oxide, or the like.

In addition, board 112 is provided with connector 113 (connecting terminal) for externally receiving DC power for causing LED light source 111 to emit light, and a metal line (not illustrated) for supplying DC power to LED light source 111. Connector 113 and power source 500 are electrically connected by a pair of leads 114. Metal line is formed into a predetermined pattern.

First casing 120 includes body 121 for attaching light emitter 110, and light-transmissive cover 122 which covers light emitter 110.

Body 121 is a metal casing having an elongate shape. Since body 121 is formed of metal, it is possible to efficiently dissipate heat generated in light emitter 110 (LED light source 111).

As illustrated in FIG. 3, according to the present embodiment, body 121 includes mount 121*a* having a squared U-shape in cross-section and plate member 121*b* having a plate-like shape.

Mount 121*a* is a base member (frame) which supports light emitter 110. Light emitter 110 is disposed on mount 121*a*. More specifically, board 112 is mounted on mount 121*a* to secure board 112 to mount 121*a*, thereby light emitter 110 is held by mount 121*a*.

According to the present embodiment, mount 121*a* is made of sheet metal. For example, mount 121*a* is formed into a predetermined shape, by applying a roll forming process, press working, or the like to sheet metal (metal plate) made of a steel plate cold commercial (SPCC), for example.

Plate member 121*b* is disposed on mount 121*a* in such a manner that mount 121*a* covers an opening of mount 121*a*. Plate member 121*b* is secured to mount 121*a* by a screw or the like. It should be noted that plate member 121*b* may be provided with a mounting bracket, etc., for securing light source unit 100 to a construction material such as a wall.

Light-transmissive cover 122 is a light-transmissive covering member which has an elongate shape, and transmits light from light emitter 110 (LED light source 111). Light-transmissive cover 122 has a squared U-shape in cross-section, for example. However, light-transmissive cover 122 may have a U-shape or a semicircular arc-shape in cross-section.

Light-transmissive cover 122 is made of a light-transmissive material. Examples of the light-transmissive material include a light-transmissive resin material such as acrylic or polycarbonate, a glass material, etc.

Light-transmissive cover 122 may have light diffusion properties (light scattering properties). For example, light-transmissive cover 122 is manufactured by dispersing a light diffuse material such as a light reflection fine particle on the light-transmissive resin material, thereby allowing light-transmissive cover 122 to have the light diffusion properties. It is possible to scatter light from LED light source 11 which has high directivity, by causing light-transmissive cover 122 to have light diffusion properties. Accordingly, granular impression (luminance unevenness) due to light emission of the plurality of LED light sources 111 can be suppressed.

It should be noted that, when light-transmissive cover 122 is caused to have light diffusion properties, the configuration of light-transmissive cover 122 is not limited to the example in which the light diffuse material is dispersed inside a light-transmissive member. For example, a lacteous light diffusion film which includes a light diffuse material or the like on a surface (an inner surface or an outer surface) of the light-transmissive member may be formed, fine unevenness may be formed on the surface of the light-transmissive member by applying grain finish or the like instead of using a light diffuse material, or a dot pattern may be printed on the surface of the light-transmissive member.

In addition, light-transmissive cover 122 may be formed such that distribution of light transmitted by light emitter 110 (LED light source 111) is controlled. For example, light-transmissive cover 122 may have a lens function of light collection or light divergence.

End cover 130 is an end cap that covers an end portion in the longitudinal direction of first casing 120. According to the present embodiment, end cover 130 is attached to each of the end portions in the longitudinal direction of first casing 120. One of the two end covers 130 is provided with an insertion hole through which second power line 400 is inserted.

End cover 130 is secured to first casing 120 using, for example, an adhesive, a screw, etc. End cover 130 is, for example, a resin molding component formed using a resin material such as polybutylene terephthalate (PBT), but may be formed using a metal material.

(Communication Unit)

As illustrated in FIG. 2, communication unit 200 includes radio receiver 210 which receives a wireless signal (light control signal) for controlling a light emitting state of light emitter 110, and second casing 220 in which radio receiver 210 is housed. Communication unit 200 further includes dimmer 230 for controlling dimming of light emitter 110. Dimmer 230 is electrically connected to first power line 300. In addition, according to the embodiment, dimmer 230 is housed in second casing 220.

Radio receiver 210 is a radio module for performing wireless data communication, using the Near Field Communication system such as Bluetooth (registered trademark) communication, ZigBee (registered trademark) communication, wireless LAN communication system, infrared communication, or the like. Radio receiver 210 includes an antenna for receiving a wireless signal. The antenna is, for example, a pattern antenna formed on a module substrate, but it is not always the case.

Radio receiver 210 receives a light control signal transmitted by terminal device 600, according to an operation performed on terminal device 600 by a user. According to the present embodiment, radio receiver 210 outputs the received light control signal to dimmer 230. The light control signal is an on-off signal for turning on or off light source unit 100 (light emitter 110), a dimming signal for dimming light source unit 100 (light emitter 110), etc. The dimming signal includes information related to a dimming level, for example.

For example, when the light control signal transmitted by terminal device 600 is a dimming signal, radio receiver 210 receives, as a wireless signal, a dimming signal for controlling dimming of light emitter 110, and outputs the received dimming signal to dimmer 230.

It should be noted that radio receiver 210 may receive a control signal other than the light control signal for controlling a light emitting state of light emitter 110.

Second casing 220 is a box for housing radio receiver 210 and dimmer 230. Second casing 220 may be formed of a material which can transmit the wireless signal transmitted by terminal device 600, and is formed using, for example, an insulating resin material.

Dimmer 230 is a device for controlling dimming of light emitter 110, and adjusts luminance (light output) of light emitter 110. According to the present embodiment, dimmer 230 adjusts power supplied to light emitter 110, according to the light control signal received by radio receiver 210, thereby adjusting light output of light emitter 110. In other words, dimmer 230 converts the dimming signal received from radio receiver 210 into a signal which issues a dimming instruction.

More specifically, dimmer 230 is capable of controlling dimming of light emitter 110 by a phase control method. In this case, dimmer 230 cuts off a portion of AC power (AC waveform) transmitted from plug 310 via first power line 300, according to the dimming signal received by radio receiver 210, and then transmits the AC power from which the portion has been cut off to power source 500 via power line 400. In this manner, it is possible to cause light emitter 110 to emit light at luminance according to a dimming level of the dimming signal.

It should be noted that dimmer 230 may control dimming of light emitter 110 by a pulse width modulation (PWM) control method, instead of the phase control method. In this case, a PWM signal of a predetermined duty ratio is generated on the basis of the dimming signal received by radio receiver 210, and transmits the PWM signal to power source 500. It should be noted that, when a PWM signal is transmitted from dimmer 230 to power source 500 in a wired manner, a signal line for transmitting the PWM signal needs to be provided. The signal line may be individually provided in second power line 400 separately from the power line for transmitting AC power, or may be individually provided as a cable line different from second power line 400.

(First Power Line)

As illustrated in FIG. 1 and FIG. 2, first power line 300 is a power code attached with a plug which includes plug 310, and is connected to communication unit 200. Specifically, first power line 300 is connected to second casing 220.

First power line 300 has one end attached to plug 310. Plug 310 is an attaching plug, and plugged into an outlet for receiving commercial AC power. Plug 310 receives commercial AC power, by being plugged into the outlet.

First power line 300 has the other end connected to second casing 220. More specifically, the other end of first power line 300 is electrically and mechanically connected to dimmer 230. Accordingly, the AC power received by plug 310 is supplied to dimmer 230 via first power line 300.

First power line 300 includes, for example, a pair of power lines for transmitting AC power. Accordingly, the AC power received by plug 310 is transmitted to dimmer 230 via the pair of power lines. The pair of power lines are insulation protected by, for example, being disposed in an insulation tube or being covered for insulation. It should be noted that first power line 300 may be separately provided with a ground line other than the pair of power lines.

(Second Power Line)

As illustrated in FIG. 1 and FIG. 2, second power line 100 connects light source unit 100 and communication unit 200. Specifically, second power line 400 connects first casing 120 and second casing 220.

Second power line 400 has one end inserted to the insertion hole of end cover 130, and is electrically and mechanically connected to an input terminal of power source 500 housed in first casing 120. The other end of second power line 400 is electrically and mechanically connected to an output terminal of dimmer 230 housed in second casing 220.

Second power line 400 includes, for example, a pair of power lines for transmitting AC power. Accordingly, the AC power which is phase-controlled by dimmer 230 according to the dimming signal is transmitted to power source 500 via the pair of power lines. The pair of power lines are insulation protected by, for example, being disposed in an insulation tube or being covered for insulation. It should be noted that second power line 400 may be separately provided with a ground one other than the pair of power lines.

(Power Source)

As illustrated in FIG. 2, power source 500 is a power supplying device (power unit) which generates power for causing light emitter 110 to emit light, using the power received by plug 310 of first power line 300. According to the present embodiment, power source 500 is housed in first casing 120 of light source unit 100. More specifically, power source 500 is housed in an internal space of body 121.

Power source 500, for example, includes a power supply circuit which converts the commercial AC power received by plug 310 into DC power of a predetermined level, by rectifying, smoothing, stepping-down, etc., the commercial AC power. According to the present embodiment, AC power which is phase-controlled according to a dimming signal is transmitted to power source 500, and thus DC power according to a dimming level is generated. The DC power generated in power source 500 is supplied to light emitter 110 (LED light source 111) via lead 114.

Power source 500, for example, includes a circuit board and a plurality of electronic components mounted on the circuit board. The circuit board is a printed circuit board (PCB) including one surface (solder surface) on which a metal line such as a copper foil is patterned. The plurality of electronic components mounted on the circuit board are plurality of circuit elements for causing LED light source 111 to emit light. Examples of the circuit element include, for example, a capacitative element such as an electrolytic capacitor and a ceramic capacitor, a resistive element such as a resistor, a rectifier circuit element, a coil element, a choke coil (choke trans), a noise filter, a diode, a semiconductor element such as an integrated circuit element, etc. It should be noted that power source 500 may be housed in a circuit case.

[Advantageous Effects, etc.]

Figure 4:
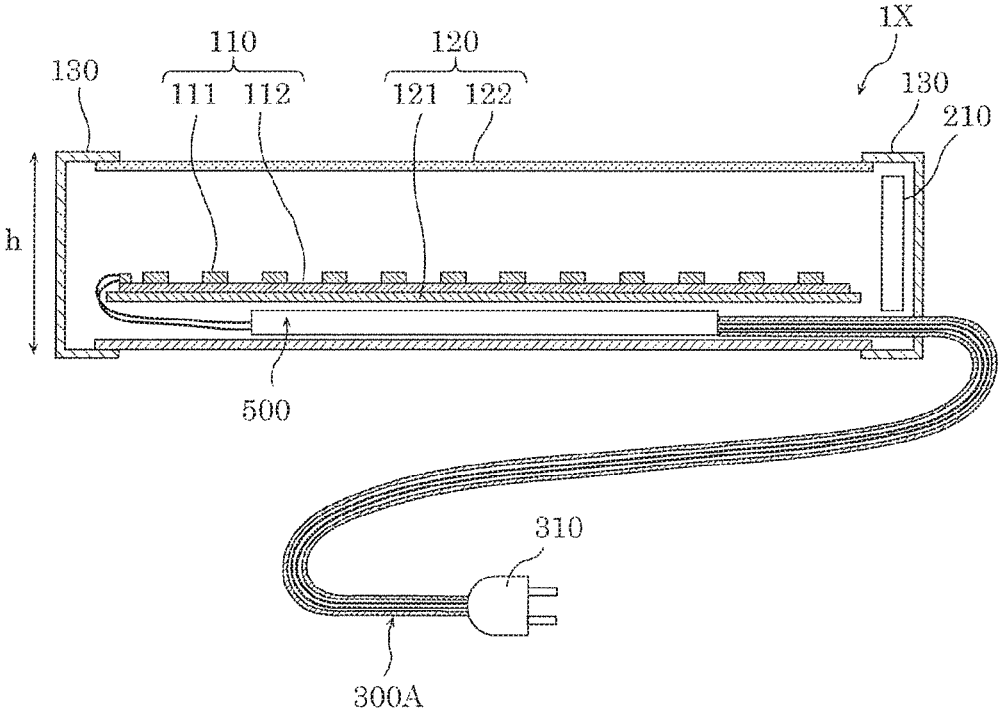
FIG. 4 is a cross-section diagram which schematically illustrates an internal configuration of a lighting apparatus according to a comparison example.

The following describes, with reference to FIG. 4, an advantageous effect of lighting apparatus 1 according to the present embodiment, together with circumstances leading to the present disclosure. FIG. 4 is a cross-sectional diagram which schematically illustrates an internal configuration of lighting apparatus 1X according to a comparison example.

In order to allow a user to easily install a lighting apparatus, or to enable freely changing an installation location of a lighting apparatus even after installation is done, a lighting apparatus which includes a code attached with a plug has been proposed. In addition, in recent years, a lighting apparatus having a radio control function has been under consideration.

In view of the above, lighting apparatus 1X provided with a code attached with a plug and having a radio control function as illustrated in FIG. 4 has been under consideration. Lighting apparatus 1X includes light emitter 110 disposed on body 121, radio receiver 210 which receives a wireless signal for controlling a light emitting state of light emitter 110, and power line 300A attached with plug 310.

However, in lighting apparatus 1X having the radio control function, there is a restriction on a position at which radio receiver 210 is disposed.

Firstly, body 121 of lighting apparatus 1X may be made of metal in order to efficiently dissipate heat generated in light emitter 110. However, since a wireless signal is reflected by metal, radio receiver 210 cannot be disposed in body 121 when body 121 is made of metal. In particular, when light emitter 110 is formed of an LED, since an LED has characteristics that light-emitting efficiency is decreased by heat generation of the LED itself, causing decreased light output, body 121 may be made of metal for ensuring heat dissipation performance of the LED. However, forming of an LED by metal results in difficulty in placing radio receiver 210 in body 121.

For that reason, as illustrated in FIG. 4, it is conceivable that radio receiver 210 is housed inside end cover 130 made of a resin. However, since radio receiver 210 (radio module) has a relatively elongate shape, height h of lighting apparatus 1X increases when radio receiver 210 is housed inside end cover 130, leading to an increase in size of lighting apparatus 1X more than necessary. In other words, restriction is posed on a size of lighting apparatus 1X.

Secondly, although radio receiver 210 may be disposed at a position away from light emitter 110 in order to avoid influence of heat generated by light emitter 110, an increase in the distance between light emitter 110 and radio receiver 210 leads to an increase in the size of lighting apparatus 1X. In particular, light emitter 110 is likely to have a high temperature when light emitter 110 is formed of an LED, and thus there are cases where radio receiver 210 need to be disposed at a position distant from light emitter 110. As described above, it is difficult to dispose radio receiver 210 ensuring a sufficient distance from light emitter 110, without increasing the size of lighting apparatus 1X.

Thirdly, in lighting apparatus 1X illustrated in FIG. 4, light emitter 110 which performs the lighting function and radio receiver 210 which performs the communication function are housed in the same casing, and thus receiver sensitivity of radio receiver 210 is uniquely determined by an installation location of lighting apparatus 1X. For that reason, lighting apparatus 1X having the radio control function is provided with a low degree of freedom of the installation location. In other words, it is necessary to install lighting apparatus 1X in consideration of the position at which radio receiver 210 is disposed.

As described above, there is a problem, in conventional lighting apparatus 1X having the radio control function, that the degree of freedom of the position at which radio receiver 210 is disposed is low.

In view of the above, in lighting apparatus 1 according to the present embodiment, light emitter 110 (light source unit 100) which performs the lighting function and radio receiver 210 (communication unit 200) which performs the communication function are separated, and light emitter 110 and radio receiver 210 are housed in different casings, as illustrated in FIG. 1 and FIG. 2. In other words, light emitter 110 (light source unit 100) and radio receiver 210 (communication unit 200) are caused to function as different components. More specifically, light emitter 110 is housed in first casing 120, and radio receiver 210 is housed in second casing 220.

In this manner, it is possible to increase the degree of freedom of the position at which radio receiver 210 is disposed. Accordingly, since light emitter 110 and radio receiver 210 can be disposed at different positions, body 121 for attaching light emitter 110 can be made of metal, making it possible to efficiently dissipate heat generated in light emitter 110. In addition, since it is possible to easily ensure a distance between light emitter 110 and radio receiver 210, making it possible to reduce influence, on radio receiver 210, of heat generated by light emitter 110. In addition, light emitter 110 (light source unit 100) which performs the lighting function and radio receiver 210 (communication unit 200) which performs the communication function are physically separated by different casings. Accordingly, it is possible to install communication unit 200 irrespective of the mounting position of light source unit 100, and vice versa, it is possible to install light source unit 100 irrespective of the mounting position of communication unit 200.

Furthermore, since it is not necessary to house radio receiver 210 inside end cover 130, unlike the example as illustrated in FIG. 4, it is possible to a void an increase in the size of lighting apparatus 1 due to an increase in the height of lighting apparatus 1. In other words, it is impossible to implement lighting apparatus 1 including light source unit 100 provided with a high degree of freedom of design.

In addition, it is possible, by separating light source unit 100 and communication unit 200, to design first casing 120 of light source unit 100 without restriction imposed by communication unit 200. In other words, since a higher degree of freedom of design is provided to first casing 120, it is possible to adopt various designs for first casing 120.

Furthermore, since lighting apparatus 1 includes first power line 300 attached with plug 310, user can easily install lighting apparatus 1. In addition, it is possible to freely change the installation location of lighting apparatus 1 even after installation is done, as long as there is an outlet.

In addition, in lighting apparatus 1 according to the present embodiment, power source 500 is housed in first casing 120. In other words, power source 500 is built into light source unit 100.

In this manner, it is possible to implement light source unit 100 with a built-in power source.

In addition, lighting apparatus 1 according to the present embodiment includes dimmer 230 that is electrically connected to first power line 300 and is for controlling dimming of light emitter 110. Radio receiver 210 receives, as a wireless signal, a dimming signal for controlling dimming of light emitter 110, and outputs the received dimming signal to dimmer 230.

In this manner, dimming of light emitter 110 is controlled when radio receiver 210 receives the dimming signal transmitted by terminal device 600. Accordingly, a user can perform dimming of light source unit 100 by operating terminal device 600.

In addition, according to the present embodiment, dimmer 230 is housed in second casing 220.

With this configuration, AC power that is received by plug 310 and transmitted to second casing 220 via first power line 300 is subjected to dimming control by dimmer 230 and supplied to power source 500. Accordingly, light emitter 110 which emits light using power transmitted by power source 500 emits light at a dimming level corresponding to the AC power that has been subjected to dimming control.

In addition, lighting apparatus 1 according to the present embodiment includes second power line 400 which connects light source unit 100 and communication unit 200.

With this configuration, it is possible to supply AC power that is received by plug 310 and transmitted to second casing 220 via first power line 300, to light source unit 100 by second power line 400. More specifically, the AC power transmitted to second casing 220 is supplied to power source 500 by second power line 400.

(Modification)

Although the lighting apparatus according to the present disclosure has been described on the basis of the embodiment, the present disclosure is not limited to the above-described embodiment.

Figure 5:
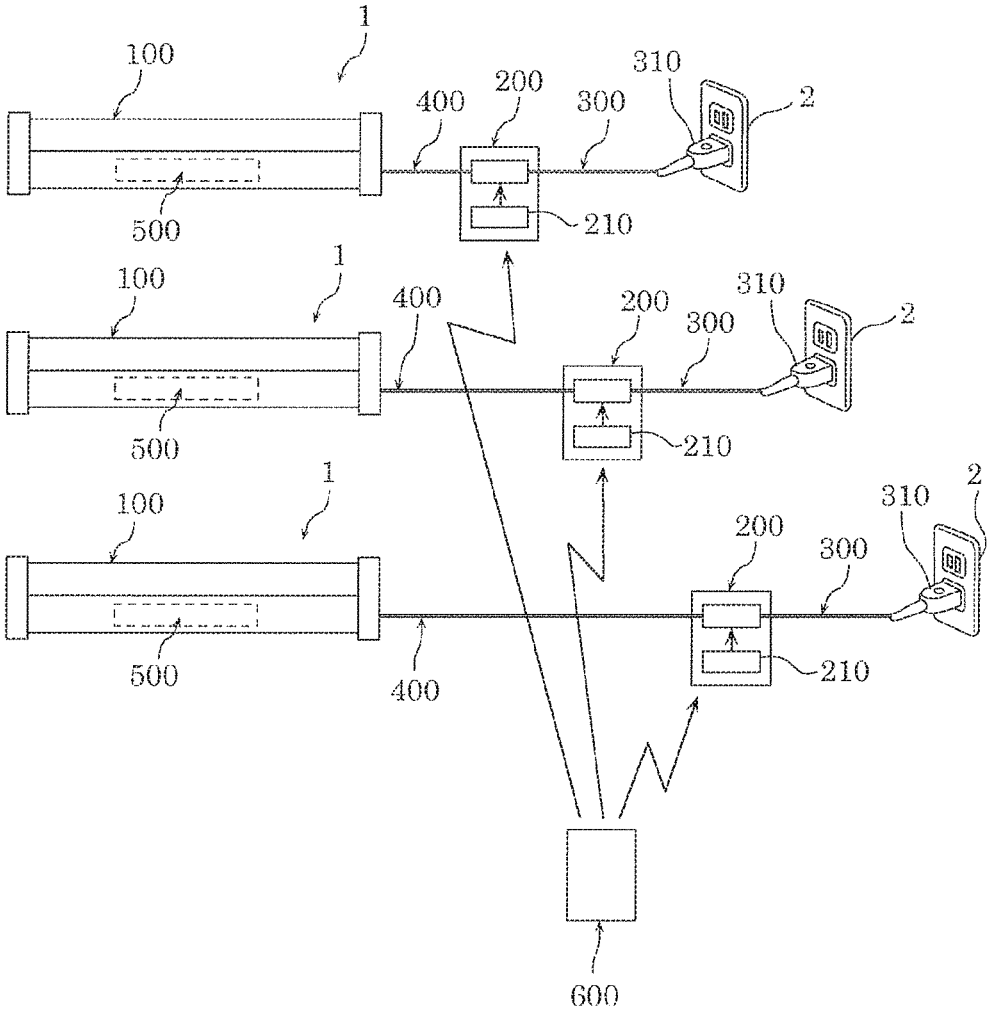
FIG. 5 is a diagram which illustrates a use example of the lighting apparatus according to the embodiment.

For example, although one lighting apparatus 1 is controlled by one terminal device 600 according to the foregoing embodiment, the present disclosure is not limited to this example. Specifically, as illustrated in FIG. 5, one terminal device 600 may control a plurality of lighting apparatuses 1. in this case, in response to an operation by a user, terminal device 600 transmits a light control signal to radio receiver 210 of each of the plurality of lighting apparatuses 1. In this manner, the user can simultaneously control the light emitting state of a plurality of light source units 100, by operating only one terminal device 600. It should be noted that, in each of the plurality of lighting apparatuses 1, although plug 310 is plugged into outlet 2, for example, plug 310 may be connected to an outlet tap, an extension cord, or the like.

Figure 6:
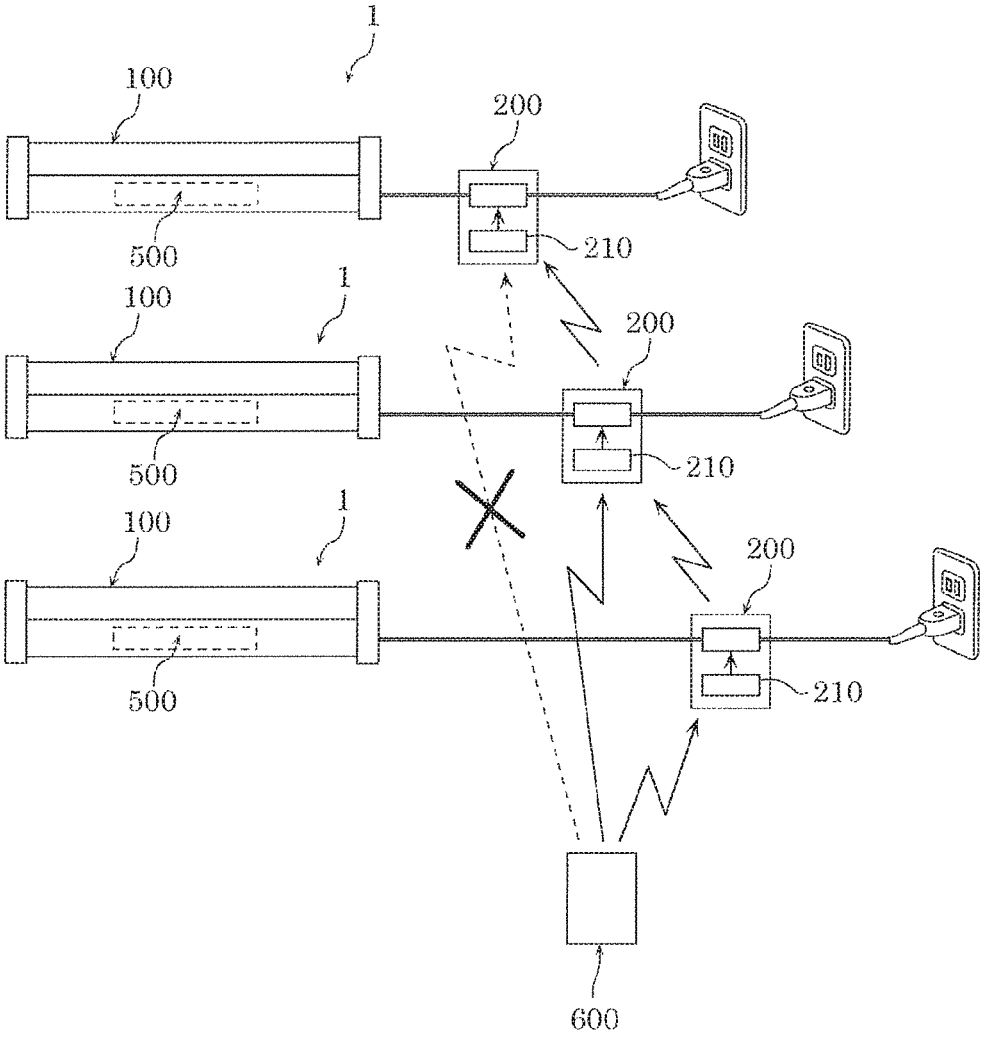
FIG. 6 is a diagram which illustrates a configuration of a lighting apparatus according to Modification 1.

As described above, when a plurality of lighting apparatuses 1 are controlled by one terminal device 600, there are instances where a wireless signal transmitted by terminal device 600 does not directly reach one or more radio receivers 210, depending on, for example, the positions at which communication units 200 of the plurality of lighting apparatuses 1 are arranged, as illustrated in FIG. 6. Accordingly, in order to be able to receive a wireless signal from terminal device 600 even in such a case, radio receiver 210 of each of the plurality of lighting apparatuses 1 may be configured to transmit a wireless signal that is the same signal as the control signal transmitted by terminal device 600. More specifically, radio receiver 210 of each of the plurality of lighting apparatuses 1 may include a circuit or the like which transmits a received wireless signal to radio receiver 210 of one or more of the plurality of lighting apparatuses 1 other than lighting apparatus 1 including the circuit or the like transmitting the received wireless signal. With this configuration, even when a wireless signal transmitted by terminal device 600 does not directly reach one or more radio receivers 210, the one or more radio receivers 210 are capable of indirectly receiving the wireless signal transmitted by terminal device 600 by receiving a wireless signal transmitted by radio receiver 210 of another communication unit 200. Accordingly, it is possible to perform the same control as other lighting apparatuses 1.

In addition, although one light source unit 100 corresponds to one communication unit 200 according to the foregoing embodiment, the present disclosure is not limited to this example.

Figure 7:
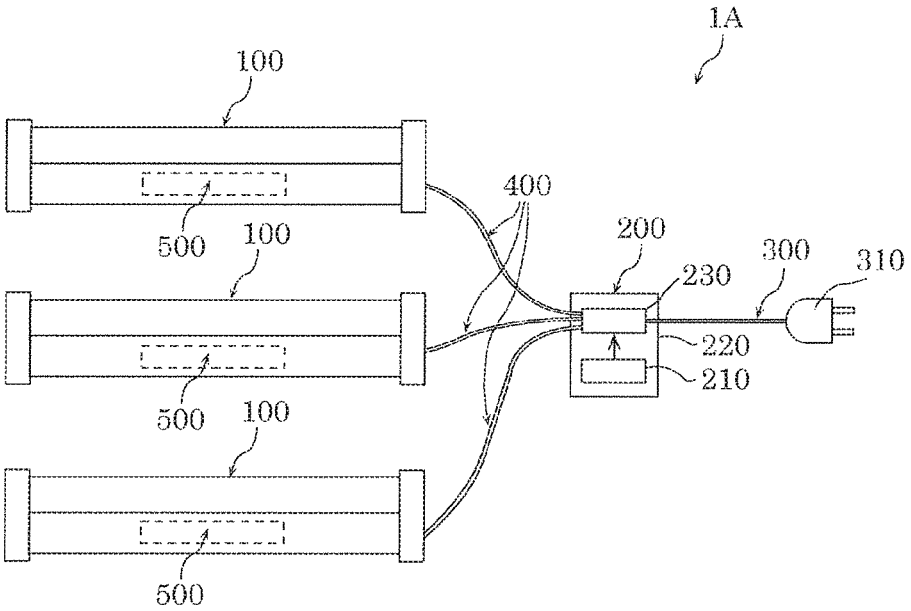
FIG. 7 is a diagram which illustrates a configuration of a lighting apparatus according to Modification 2.

For example, as lighting apparatus 1A illustrated in FIG. 7, a plurality of light source units 100 may correspond to one communication unit 200. More specifically, lighting apparatus 1A includes a plurality of light source units 100, and also a plurality of second power lines 400 so as to correspond to the number of the plurality of light source units 100. The plurality of second power lines 400 are drawn out of second casing 220 which is the same second casing, and connected to the plurality of light source units 100 in a one-to-one relationship. In this manner, a plurality of light source units 100 are connected to one communication unit 200 using a plurality of second power lines 400, and thereby it is possible to simultaneously control the light emitting state of the plurality of light source units 100, by only transmitting a light control signal to the one communication unit 200. This allows performing of lighting control in which a plurality of light source units 100 are operated in conjunction with one another, and thus it is possible to create effective illumination rendering.

Figure 8:
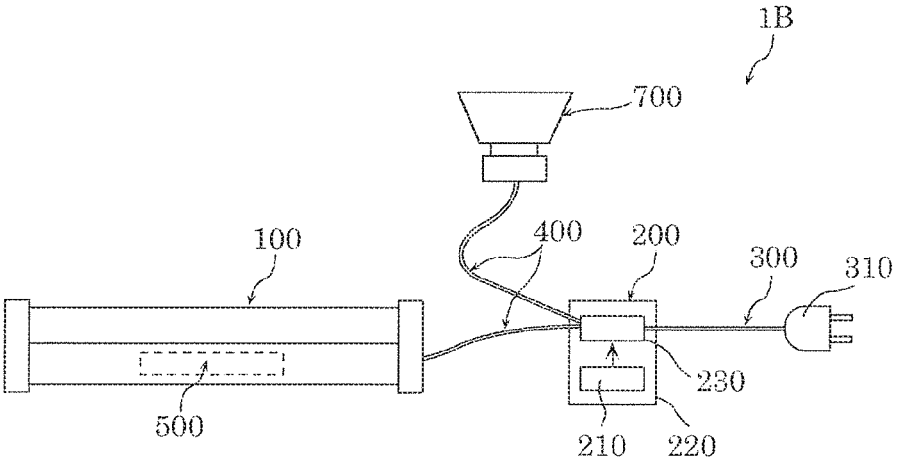
FIG. 8 is a diagram which illustrates a configuration of a lighting apparatus according to Modification 3.

Alternatively, as lighting apparatus 1B illustrated in FIG. 8, another electrical device, together with light source 100, may correspond to one communication unit 200. Specifically, lighting apparatus 1B includes a plurality of second power lines 400, and the plurality of second power lines 400 are drawn out of second casing 220 which is the same second casing 220. At least one of the plurality of second power lines 100 drawn out of second casing 220 is connected to light source unit 100, and at least another one of the plurality of second power lines 400 drawn out of second casing 220 is connected to electrical device 700. More specifically, in FIG. 8, two second power lines 400 are provided, one of which is connected to light source unit 100 and the other is connected to electrical device 700. In addition, electrical device 700 connected to second power line 400 is a speaker, for example. However, electrical device 700 is not limited to a speaker. In this manner, light source unit 100 and electrical device 700 are connected to one communication unit 200 using a plurality of second power lines 400, and thereby it is possible to simultaneously control light source unit 100 and electrical device 700 by only transmitting a control signal to the one communication unit 200. For example, it is possible to turn on or off a speaker simultaneously with turning on or off light source unit 100, or to control the light emitting state of light source unit 100 according to sound tone of a speaker.

In addition, although light source unit 100 and communication unit 200 are connected by second power line 400 and transmitting and receiving of a signal and power are performed in a wired manner according to the foregoing embodiment, the present disclosure is not limited to this example. For example, transmitting and receiving of a signal and power may be performed wirelessly between light source unit 100 and communication unit 200. It should be noted that, in this case, transmitting of power from communication unit 200 to light source unit 100 can be carried out using noncontact power supply. Alternatively, only a light control signal may be transmitted from communication unit 200 to light source unit 100, and a primary battery or a secondary battery built into light source unit 100 may be used as a power source.

In addition, although dimmer 230 is housed in communication unit 200 (second casing 220) according to the foregoing embodiment, the present disclosure is not limited to this example. For example, dimmer 230 may be housed in light source unit 100 (first casing 120).

In addition, although a light source of light emitter 110 is LED light source 111 according to the foregoing embodiment, the present disclosure is not limited to this example. For example, the light source of light emitter 110 may be a different solid-state light-emitting element such as a semiconductor laser or an organic electro luminescence (EL), or may be an existing lamp light source such as a fluorescent lamp.

In addition, although turning on or off (ON/OFF) of light source unit 100 (light emitter 110) is performed using a wireless signal transmitted by radio receiver 210 according to the foregoing embodiment, the present disclosure is not limited to this example. For example, turning on or off of light source unit 100 (light emitter 110) may be performed using mechanical switch 140 provided to light source unit 100 as illustrated in FIG. 1.

In addition, in the foregoing embodiment, a rewinding mechanism such as a code reel for rewinding first power line 300 may be built into second casing 220. In the same manner as above, a rewinding mechanism such as a code reel fin rewinding second power line 400 may be built into first casing 120 or second casing 220. With this configuration, it is possible to adjust, by the rewinding mechanism, the length of first power line 300 exposed from second casing 220 or the length of second power line 400 exposed from second casing 220. In addition, it is possible to make the code lengths of first power line 300 and second power line 400 long, by including an built-in rewinding mechanism. Accordingly, it is possible to further improve the degree of freedom of disposition of light source unit 100 and communication unit 200.

In addition, in the foregoing embodiment, lighting apparatus 1 may include a human sensor or an illuminance sensor for controlling a light emitting state of light source unit 100. The human sensor or the illuminance sensor may be disposed in first casing 120 or second casing 220 according to the purpose or usage.

In addition, in the foregoing embodiment, lighting apparatus 1 may have not only the dimming function, but also a color-adjust function. In this case, light emitter 110 includes, for example, a plurality of LED light sources 111 having different color temperatures.

In addition, although light emitter 110 has an SMD structure in which an SMD light-emitting element is used as LED light source 111 according to the foregoing embodiment, the present disclosure is not limited to this example. For example, light emitter 110 may have a chip on board (COB) structure. In this case, light emitter 110 includes board 112, one or more LED chips (bare chip) directly mounted on board 112, and sealing member such as a phosphor-containing resin which seals the LED chips.

It should be noted that the present disclosure also includes other forms in which various modifications apparent to those skilled in the art are applied to the above-described embodiment and modification examples or forms in which structural components and functions in the above-described embodiment and modification examples are arbitrarily combined within the scope of the present disclosure.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting apparatus, comprising:

a light source housing including a light emitter and a first casing in which the light emitter is housed;

a communication housing including a radio receiver which receives a wireless signal for controlling a light emitting state of the light emitter, and a second casing in which the radio receiver is housed;

a first power line including a plug and being connected to the communication housing; and a power source which generates power for causing the light emitter to emit light, using power received by the plug, wherein the light source housing and the communication housing are separate from each other and are separately movable with respect to each other so that mounting positions of the light source housing and the communication housing at an installation location at which the lighting apparatus is installed are separately changeable.

2. The lighting apparatus according to claim 1, wherein the power source is housed in the first casing.

3. The lighting apparatus according to claim 1, further comprising:

a dimmer which is electrically connected to the first power line and controls dimming of the light emitter, wherein the radio receiver receives, as the wireless signal, a dimming signal for controlling dimming of the light emitter, and outputs the received dimming signal to the dimmer.

4. The lighting apparatus according to claim 3, wherein the dimmer is housed in the second casing.

5. The lighting apparatus according to claim 1, further comprising a second power line which connects the light source housing and the communication housing.

6. The lighting apparatus according to claim 5, further comprising a plurality of the light source housings, and a plurality of the second power lines, and wherein the plurality of the second power lines are drawn out of the second casing of the communication housing and are connected to the plurality of the light source housings in a one-to-one relationship.

7. The lighting apparatus according to claim 5, further comprising a plurality of the second power lines, each drawn out of the second casing of the communication housing, at least one of the plurality of the second power lines that is drawn out of the second casing of the communication housing being connected to the light source housing, and at least another one of the plurality of the second power lines that is drawn out of the second casing of the communication housing being connected to an electrical device.

8. The lighting apparatus according to claim 7, wherein the electrical device is a speaker.

9. The lighting apparatus according to claim 1, wherein the lighting apparatus is a first lighting apparatus that communicates with a second lighting apparatus, wherein the radio receiver of the communication housing of the first lighting apparatus includes a circuit which transmits the received wireless signal to a radio receiver of a communication housing of the second lighting apparatus.

10. The lighting apparatus according to claim 1, wherein the first casing of the light source housing includes:

a body configured to attach to the light emitter; and a light-transmissive cover which covers the light emitter.

11. The lighting apparatus according to claim 5, wherein the second power line is exposed from the second casing of the communication housing.

* * * * *